US009975738B2

(12) United States Patent
Ramakrishnan et al.

(10) Patent No.: US 9,975,738 B2
(45) Date of Patent: May 22, 2018

(54) METHOD AND SYSTEM FOR MODERNIZING AN ELEVATOR INSTALLATION AND CONTROLLING ELEVATORS DURING MODERNIZATION

(71) Applicant: KONE CORPORATION, Helsinki (FI)

(72) Inventors: Narendran Ramakrishnan, Aminjiarai (IN); Muralikrishnan Bangaru, Thiruvottiyur (IN)

(73) Assignee: KONE CORPORATION, Helsinki (FI)

( * ) Notice: Subject to any disclaimer, the term of this patent is extended or adjusted under 35 U.S.C. 154(b) by 340 days.

(21) Appl. No.: 14/734,735

(22) Filed: Jun. 9, 2015

(65) Prior Publication Data

US 2015/0274488 A1 Oct. 1, 2015

Related U.S. Application Data

(63) Continuation of application No. PCT/FI2013/050018, filed on Jan. 9, 2013.

(51) Int. Cl.

| | |
|---|---|
| ***B66B 1/28*** | (2006.01) |
| ***B66B 19/00*** | (2006.01) |
| ***B66B 1/24*** | (2006.01) |
| ***B66B 1/18*** | (2006.01) |

(Continued)

(52) U.S. Cl.

CPC ..... *B66B 19/007* (2013.01); *B66B 1/18* (2013.01); *B66B 1/2458* (2013.01); *B66B 1/3461* (2013.01); *B66B 1/468* (2013.01); *B66B 2201/103* (2013.01); *B66B 2201/211* (2013.01); *B66B 2201/215* (2013.01); *B66B 2201/216* (2013.01); *Y10T 29/49826* (2015.01)

(58) Field of Classification Search

CPC ..... B66B 19/007; B66B 1/18; B66B 1/2458; B66B 1/3461; B66B 1/468; B66B 5/0025; B66B 2201/103; B66B 2201/211; B66B 2201/215; B66B 2201/216

USPC ..... 187/247, 248, 277, 284, 291–293, 316, 187/391–394

See application file for complete search history.

(56) References Cited

U.S. PATENT DOCUMENTS 5,352,857 A * 10/1994 Ovaska ..... B66B 1/18 187/247
5,357,064 A * 10/1994 Boyce ..... B66B 19/007 187/247

(Continued)

FOREIGN PATENT DOCUMENTS

FI 123017 B 10/2012

*Primary Examiner* — Anthony Salata
(74) *Attorney, Agent, or Firm* — Birch, Stewart, Kolasch & Birch, LLP

(57) ABSTRACT

A method and a system for modernizing an elevator installation including two or more elevators includes an unmodernized elevator, one or more call-giving devices, a new group controller, which is connected to the elevator installation for allocating an elevator call to be given with a call-giving device to be served by an elevator belonging to the elevator installation, and also a measuring device, which is configured to measure an operating parameter of an unmodernized elevator. The aforementioned measuring device is connected to the new group controller for communicating the aforementioned operating parameter to the new group controller.

20 Claims, 3 Drawing Sheets

(51) Int. Cl.
*B66B 1/34* (2006.01)
*B66B 1/46* (2006.01)

(56) References Cited

U.S. PATENT DOCUMENTS

| | | | | |
|---|---|---|---|---|
| 5,389,748 | A * | 2/1995 | Burke | B66B 1/18 187/247 |
| 6,427,807 | B1 * | 8/2002 | Henneau | B66B 1/34 187/247 |
| 6,892,861 | B2 * | 5/2005 | Friedli | B66B 1/28 187/247 |
| 7,900,750 | B2 * | 3/2011 | Mattsson | B66B 1/2458 187/247 |
| 8,172,043 | B2 * | 5/2012 | Hughes | B66B 1/2458 187/382 |
| 8,517,149 | B2 * | 8/2013 | Flynn | B66B 1/2458 187/247 |
| 8,640,831 | B2 * | 2/2014 | Talonen | B66B 1/2458 187/391 |
| 8,967,335 | B2 * | 3/2015 | Friedli | B66B 1/2458 187/247 |
| 9,033,114 | B2 * | 5/2015 | Mizon | B66B 1/00 187/247 |
| 9,079,750 | B2 * | 7/2015 | Endo | B66B 1/2458 |
| 9,617,115 | B2 * | 4/2017 | Sarjanen | B66B 1/2458 |
| 2014/0174861 | A1 | 6/2014 | Sarjanen et al. | |

* cited by examiner 1A, 1B, 1C: unmodernized elevators
2: new group controller
3: destination call panel
4: interface units
4': measuring devices
5A, 5B, 5C: destination floors
6: elevator cars
7A, 7B: magnets
8A, 8B: reed switches
10: elevator control units
11: movement control units
12: serial interface bus
13: call-giving pushbuttons
14: hoisting machines

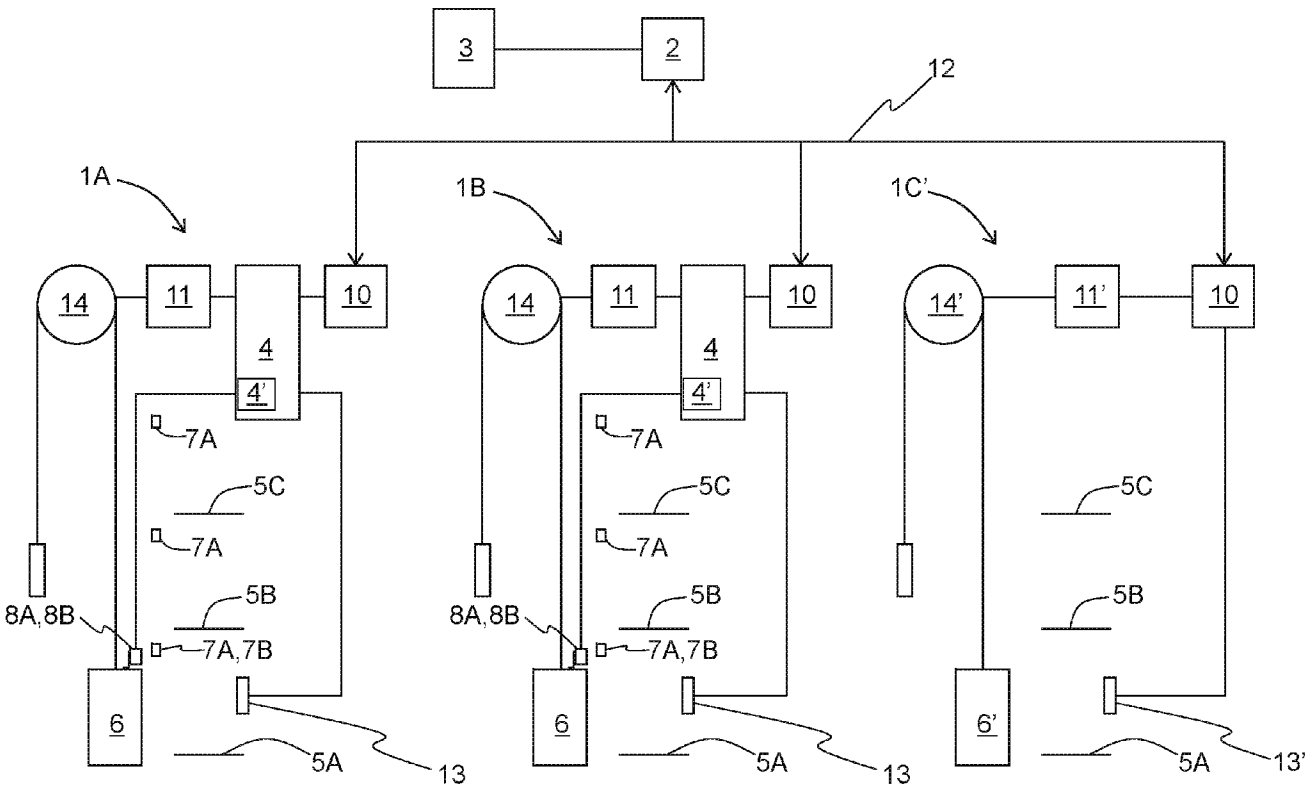

Fig. 2

1A, 1B: unmodernized elevators
1C': modernized elevator
2: new group controller
3: destination call panel
4: interface units
4': measuring devices
5A, 5B, 5C: destination floors
6: elevator cars
6': elevator car of the modernized elevator 1C'
7A, 7B: magnets
8A, 8B: reed switches
10: elevator control units
11: movement control units
11': frequency converter
12: serial interface bus
13: call-giving pushbuttons
13': call-giving pushbutton of the modernized elevator 1C'
14: hoisting machines
14': hoisting machine of the modernized elevator 1C'

4': measuring device
7A, 7B: magnets
8A, 8B: reed switches
9: trailing cable
10: elevator control unit
12: serial interface bus
15: communication bus

METHOD AND SYSTEM FOR MODERNIZING AN ELEVATOR INSTALLATION AND CONTROLLING ELEVATORS DURING MODERNIZATION

CROSS REFERENCE TO RELATED APPLICATIONS

This application is a Continuation of PCT International Application No. PCT/FI2013/050018 filed on Jan. 9, 2013, which is hereby expressly incorporated by reference into the present application.

FIELD OF THE INVENTION

The invention relates to solutions for modernizing an elevator installation comprising two or more elevators.

BACKGROUND OF THE INVENTION

It is usual that the elevator installation of a building is modernized from time to time. A reason for modernization can be e.g. an increase in maintenance costs resulting from obsolescent elevator technology. It is also possible that the aim is to improve the transport capacity of the elevators by modernizing the elevator technology. New elevators are often also more space-efficient than earlier, in which case by modernizing the elevators space can be released in the building for some other use.

In particular, the modernization of an elevator installation in large buildings having many elevators can last for many months or even, in some cases, years. Prolongation of the modernization can hamper use of the building. On the other hand, the elevators should be in use also in the transition phase, when only some of the elevators are modernized and the elevator installation of the building is composed of both modernized and still unmodernized elevators. In addition, use of the elevators should be as smooth as possible from the viewpoint of an elevator passenger also in the transition phase.

AIM OF THE INVENTION

The aim of the present invention is to solve the aforementioned drawbacks as well as the drawbacks disclosed in the description below.

To achieve this aim a method and also a system for modernizing an elevator installation comprising two or more elevators are disclosed. The preferred embodiments of the invention are described in the dependent claims. Some inventive embodiments and inventive combinations of the various embodiments are also presented in the descriptive section and in the drawings of the present application.

SUMMARY OF THE INVENTION

In the method according to the invention for modernizing an elevator installation comprising two or more elevators a new group controller is connected to the elevator installation, which group controller is operable to allocate an elevator call given with a call-giving device to be served by an elevator belonging to the elevator installation, a new measuring device is fitted to an unmodernized elevator, which measuring device is operable to measure an operating parameter of the unmodernized elevator, and also the aforementioned measuring device is connected to the new group controller for communicating the measured operating parameter to the new group controller. The aforementioned operating parameter can be e.g. the speed, load, floor position and/or movement direction of an elevator car belonging to an unmodernized elevator.

In the disclosure term "old" refers to the unmodernized components of the elevator installation. Consequently, term "new" refers to the new components, which are installed, when the elevator installation is being modernized.

As a result of the combination of the new group controller according to the invention and of a new measuring device to be fitted to an unmodernized elevator, the new group controller can utilize in the allocation of elevator calls the measuring data of an operating parameter of an unmodernized elevator, i.e. measured data about the operation of the unmodernized elevator. This improves allocation results, which in turn facilitates use of the elevator and also increases the transport capacity of the elevators. In addition, taking the aforementioned combination into use is fast and simple, including only a few different work phases.

In one preferred embodiment of the invention with the new group controller an elevator to serve an elevator call is selected on the basis of at least the aforementioned operating parameter, and also with the new group controller the elevator call is allocated to an elevator selected to serve the elevator call. In this case, utilizing the measured operating parameter, the elevator traffic can be optimized more efficiently to correspond to the desired objectives for operation.

In one preferred embodiment of the invention, when the aforementioned operating parameter is the floor position of an elevator car, the aforementioned measuring device is configured to measure the floor position of an elevator car belonging to an unmodernized elevator. The floor position of the elevator car means data about the stopping floor at which, or in the immediate proximity of which, the elevator car is situated at any given time. Consequently, the new group controller can utilize in the allocation of elevator calls the measured floor position/position data of the elevator car, which improves the allocation result.

In one preferred embodiment of the invention at least one elevator is modernized, and also a new group controller is connected to the modernized elevator for allocating an elevator call to be served by the modernized elevator. In a preferred embodiment of the invention with the new group controller on the basis of the aforementioned operating parameter an unmodernized or a modernized elevator is selected to serve the elevator call, and also with the new group controller the elevator call is allocated to an elevator selected to serve the elevator call. In this case in the allocation of an elevator call in the transition phase of a modernization an allocation criterion from an operating parameter of an unmodernized elevator can be used.

In one preferred embodiment of the invention the aforementioned measuring device is provided with a sensor detecting the door zone of an elevator, and also the aforementioned sensor detecting the door zone of an elevator is fitted in connection with an elevator car belonging to an unmodernized elevator.

In one preferred embodiment of the invention a new destination call device is connected to the new group controller, with which destination call device an elevator call can be given, which comprises information about both the departure floor and about the destination floor of an elevator passenger. The aforementioned destination call device is preferably disposed outside the elevator car, such as in a lobby of the building and/or on different stopping floors of the elevator.

The system according to the invention for modernizing an elevator installation comprising two or more elevators comprises an unmodernized elevator, one or more call-giving devices, a new group controller, which is connected to the elevator installation for allocating an elevator call to be given with a call-giving device to be served by an elevator belonging to the elevator installation, and also a new measuring device, which is configured to measure an operating parameter of an unmodernized elevator. The aforementioned measuring device is connected to the new group controller for communicating the aforementioned operating parameter to the new group controller.

In one preferred embodiment of the invention the aforementioned group controller is configured to select on the basis of the aforementioned operating parameter an elevator to serve an elevator call, and also to allocate an elevator call to the elevator selected to serve the elevator call. In this case, utilizing the measured operating parameter, the elevator traffic can be optimized more efficiently to correspond to the desired objectives for operation.

In one preferred embodiment of the invention the aforementioned operating parameter is the floor position of the elevator car, and the aforementioned measuring device is configured to measure the floor position of an elevator car belonging to an unmodernized elevator. Consequently, the new group controller can utilize in the allocation of elevator calls the measured floor position/position data of the elevator car.

In one preferred embodiment of the invention the elevator installation comprises a modernized elevator, and the aforementioned group controller is configured to allocate an elevator call to be served by the modernized elevator. In one preferred embodiment of the invention the new group controller is configured to select on the basis of the aforementioned operating parameter an unmodernized or a modernized elevator to serve an elevator call, and also to allocate the elevator call to the elevator selected to serve the elevator call. In this case in the allocation of an elevator call an operating parameter of an unmodernized elevator can be used as an allocation criterion also during the transition phase of a modernization.

In one preferred embodiment of the invention the aforementioned measuring device is provided with a sensor detecting the door zone of an elevator, which sensor is fitted in connection with an elevator car belonging to an unmodernized elevator.

In one preferred embodiment of the invention the system comprises a new destination call device, which is connected to the aforementioned group controller and is also configured to form an elevator call, which comprises information about both the departure floor and about the destination floor of a passenger. The destination call device comprises a user interface, by the aid of which an elevator passenger can input destination floor data, i.e. data about the floor that is the destination of the elevator passenger. In this case when allocating an elevator call the new group controller sends to the elevator selected to serve the passenger a control command or a command string, which comprises information both about from which floor the elevator passenger must be collected and also about to which floor he/she must be conveyed. The floor from which the elevator passenger must be collected is usually the same floor as that on which the call-giving device that sent the destination call is located. When using a destination call device, the new group controller can consequently freely select the elevator to be allocated to serve an elevator passenger. This type of allocation method based on destination calls to be given from outside the elevator car enables smoother elevator traffic than before, boosts the transport capacity of the elevator, reduces waiting times, et cetera.

In one preferred embodiment of the invention the aforementioned measuring device comprises a sensor, which is connected to an unmodernized elevator. The measuring device is configured to process the measuring data received from the sensor and also to form the aforementioned operating parameter on the basis of the processed measuring data. Consequently, with the measuring device an operating parameter can be formed in the format required by the new group controller without the new group controller needing configuration specific to the elevator or specific to the elevator installation. All this reduces the work phases needed and speeds up the modernization. In a preferred embodiment of the invention the measuring device is configured to form the floor position of the elevator car by processing the measuring data to be received from the sensor detecting the door zone of the elevator and further to form the direction of movement of the elevator car on the basis of a change in the floor position data.

When the new measuring device to be fitted to an unmodernized elevator in connection with a modernization is connected to the new group controller in the manner presented in the description, the acquisition of data about the unmodernized elevator for the new group controller can be arranged more simply than in prior art, while also saving work phases. This is because, inter alia, the new group controller receives data about an operating parameter/operating parameters of the unmodernized elevator directly from the new measuring device, and consequently the new group controller does not need to be separately configured to receive measuring data from the old control apparatus of the unmodernized elevator, such as from the old group controller. Configuration of the new group controller to receive measuring data from the old control apparatus would also require additional analyses relating to the operation and structure of the old control apparatus/old group controller, and it might also require modification of the structure and interfaces of the new group controller.

The aforementioned summary, as likewise the additional features and advantages of the invention presented below, will be better understood by the aid of the following description of some embodiments, said description not limiting the scope of application of the invention.

BRIEF EXPLANATION OF THE FIGURES

FIG. 2 schematically presents a later stage in the modernization of the elevator installation of FIG. 1.

DETAILED DESCRIPTION OF THE INVENTION

Figure 1:
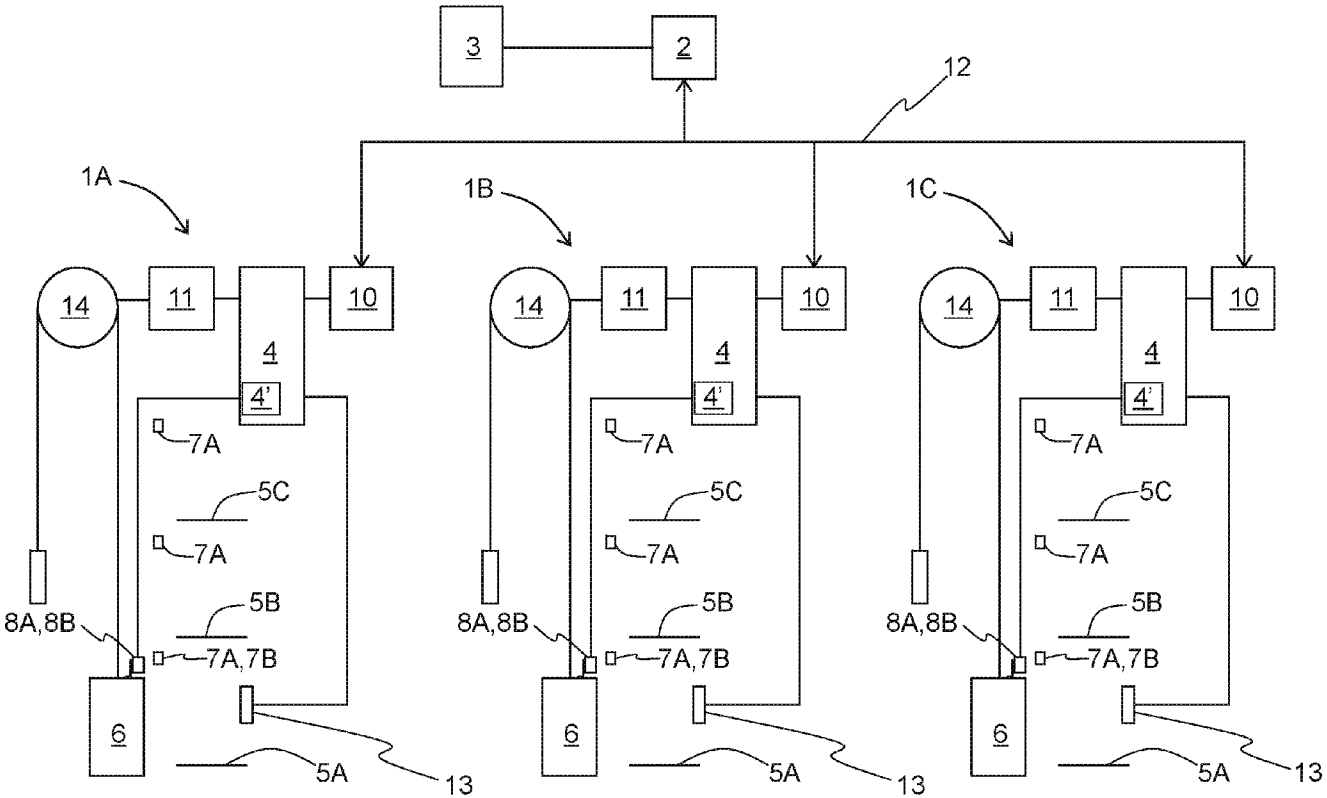
FIG. 1 schematically presents the modernization of one elevator installation in the starting phase.

FIG. 1 schematically presents the modernization of an elevator installation in the starting phase. The elevator installation comprises three old unmodernized elevators 1A, 1B, 1C, which will be modernized one at a time. Of course, there could also be more elevators to be modernized, and more elevators than one could be modernized at a time. In the starting phase of the modernization a new group controller 2, which replaces the old group controller that is to be removed, is connected to the elevator installation. The old group controller is removed from operation already in the starting phase of the modernization, and for the sake of clarity it is not presented in FIG. 1. The new group controller 2 also remains in the elevator installation permanently after the modernization.

Both the old, unmodernized elevators 1A, 1B, 1C and the new modernized elevators of the elevator installation are controlled with the new group controller 2 during the transition phase of the modernization. For controlling the unmodernized elevators 1A, 1B, 1C with the new group controller 2, new elevator control units 10 are fitted to the unmodernized elevators 1A, 1B, 1C, which elevator control units are connected to the old movement control units 11 of the unmodernized elevators via special interface units 4. The interface units 4 are added to the old elevators 1A, 1B, 1C at the same time as the new group controller 2 and the new elevator control units 10. The new group controller 2 communicates with the new elevator control units 10 via a serial interface bus 12. In this embodiment of the invention the new group controller 2, the new elevator control units 10 and also interface units 4 are disposed in the machine room of the elevator installation, where also the old movement control units 11 are situated.

Also a destination call panel 3 is added to the elevator installation, which destination call panel is connected to the new group controller 2. In the embodiment figure of FIG. 1, for the sake of clarity only one destination call panel 3 is presented. The destination call panels 3 are disposed outside the elevator cars, e.g. in the lobby of the building and on the stopping floors 5A, 5B, 5C at points via which an elevator passenger arrives at the elevator. A destination call panel 3 has destination call buttons, a touch-sensitive display or a corresponding user interface, with which an elevator passenger can enter destination floor data i.e. data about to which floor 5A, 5B, 5C he/she is traveling. With the destination call panel 3 a destination call can be formed, which comprises information about both the departure floor and about the destination floor of a passenger. In a destination call the departure floor of a passenger is in this case usually the same floor as that on which the call-giving panel 3 that sent the destination call is located. In the embodiment of FIG. 1 also the old up-down call-giving pushbuttons 13 are left in the operation of the elevator installation, and they are connected to the new elevator control unit 10 via the interface units 4 such that up-down calls are sent to the new group controller 2 via the serial interface bus 12. In some other embodiments the old call-giving pushbuttons 13 are removed completely in the starting phase of the modernization and they are replaced with destination call panels 3. The new group controller 2 receives elevator calls to be given with the call-giving devices 3, 13 and allocates the elevator calls to be served by different elevators 1A, 1B, 1C on the basis of one or more operating parameters. Usually the aim is to optimize, by means of the allocation, set performance indicators of the elevator, such as the waiting time for the elevator, the transport capacity, energy consumption, et cetera. An operating parameter can be e.g. the floor position 5A, 5B, 5C of the elevator car 6, and a call can be allocated on the basis of the floor positions of the elevator cars to be served by that elevator having an elevator car already located closest to the passenger who gave the call, in which case the waiting time for the elevator is minimized. An operating parameter can also be the load of the elevator car, and a call can be allocated on the basis of the loads of the elevator cars to be served by that elevator having an elevator car in which the movement of the elevator car to be performed for serving the call requires, when taking the load into account, the least electrical energy to be taken from the main supply of the building. An operating parameter can also be the movement direction of the elevator car, and a call can be allocated on the basis of the movement directions of the elevator cars to be served by that elevator having an elevator car with a movement direction that does not need to be changed in order to serve the call, which improves the transport capacity of the elevator. There can also be a number of operating parameters, as also performance indicators to be optimized, and the group controller can select between them by the aid of various weighting coefficients; the weighting coefficients can also vary in different operating situations. Allocation takes place by sending with the new group controller 2 via the serial interface bus 12 a control command to the elevator control unit 10 of the elevator selected to serve the call. On the basis of the received control command, the elevator control unit 10 controls the movement control unit 11. The movement control unit 11 moves the elevator car 6 according to the control of the elevator control unit by supplying current to the hoisting machine 14. In this way the elevator car collects the passenger who gave the call to be served from the departure floor 5A, 5B, 5C and conveys the passenger to the destination floor 5A, 5B, 5C according to the call to be served.

In order for the allocation of elevator calls to be possible, the new group controller 2 must have data about the momentary operating parameters of the different elevators 1A, 1B, 1C. In this embodiment of the invention the movement direction and the floor position of the elevator car, i.e. at which floor 5A, 5B, 5C, or in the immediate proximity of which floor, the elevator car 6 is at any given time, are used as operating parameters. For measuring the floor position data, reed switches 8A, 8B are fitted in the elevators 1A, 1B, 1C in connection with the elevator cars 6, with which reed switches the magnetic field formed by magnets 7A, 7B fitted in the elevator hoistway beside the path of movement of the elevator car 6 is measured. The magnets 7A, 7B are disposed such that the reed switch 8A, 8B is situated at the point of a magnet when the elevator car 6 is situated in the door zone at a stopping floor 5A, 5B, 5C at a point at which passengers are able to transfer into the elevator car and to exit the elevator car.

Figure 3:
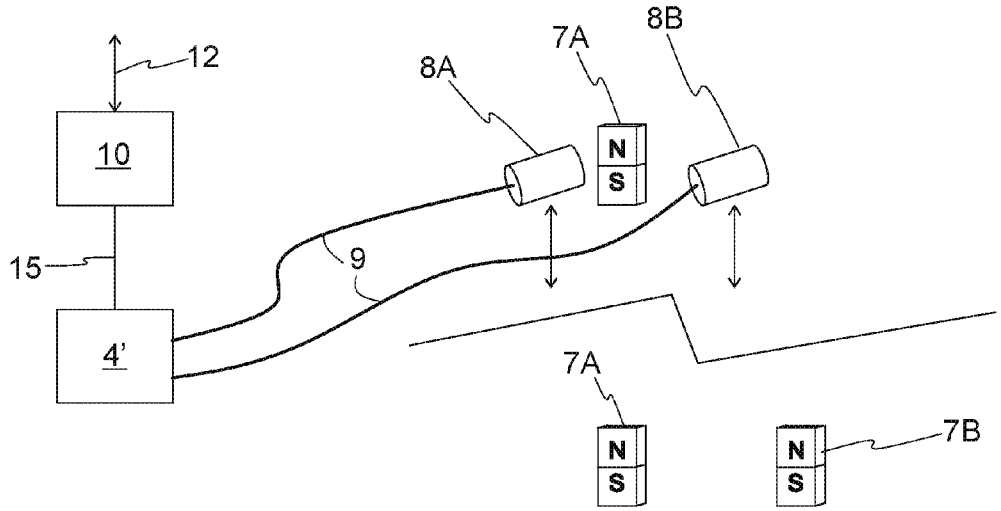
FIG. 3 illustrates the operation of a measuring device according to the embodiment of FIGS. 1 and 2.

FIG. 3 presents in more detail how two reed switches 8A, 8B are in connection with the elevator car 6 in FIG. 1, one 8A of which reed switches reads the magnets 7A disposed on different stopping floors and the other 8B reads the magnets 7B disposed on the floor of the entrance lobby of the building when the elevator car 6 is moving upwards and downwards in the elevator hoistway. The measuring signals of the reed switches 8A, 8B are taken to the interface unit 4 via a trailing cable 9. The interface unit 4 comprises a measuring device 4', which receives the measuring signals obtained from the reed switches 8A, 8B. The measuring device 4' also receives from the elevator control unit 10 via the communications bus 15 data about the drive direction of the elevator car 6 and processes the floor position of the elevator car 6 on the basis of the measuring signals obtained from the reed switches 8A, 8B and of the data about the drive direction of the elevator car 6. The measuring device 4' determines the entrance floor 5A as the floor position of the elevator car when the reed switch 8B reading the magnet 7B of the entrance floor is situated at the point of the magnet. The measuring device 4' determines that the elevator car has arrived at the floor 5B situated above the entrance floor 5A when the upward driving elevator car 6/reed switch 8A arrives at the next magnet 7A disposed on a stopping floor.

If the elevator car at floor 5B continues further upwards from the magnet 7A, it is deduced that the elevator car has arrived at floor 5C when the reed switch 8A in connection with the elevator car 6 is situated at the next magnet 7A of a stopping floor. It should be noted that a signal is received from the reed switch 7B only when the elevator car is situated at the entrance floor 5A, so that the reed switch 7B can be used in calibrating the floor position data of the elevator car 6. The floor position of an elevator car 6 moving in the elevator hoistway is updated incrementally in the manner described above, and the floor position of the elevator car 6 is calibrated, if necessary, by driving the elevator car 6 back to the entrance floor 5A.

The movement direction of the elevator car could also be measured e.g. by installing an extra reed switch in connection with the elevator car and by fitting in the elevator hoistway a magnet beside the path of movement of the extra reed switch, which magnet is disposed at a slightly different point in the vertical direction than the magnet 7A of the reed switch 8A. In this case the movement direction of the elevator car 6 could be determined from the polarity of the phase difference of the measuring signals of the extra reed switch and of the reed switch 8A. The movement direction of the elevator car 6 could also be determined by measuring the direction of rotation of the traction sheave of the hoisting machine of the elevator e.g. with a pulse encoder.

The measuring device 4' sends the floor position data 5A, 5B, 5C of the elevator car 6 to the elevator control unit 10, which sends the aforementioned data via the serial interface bus 12 onwards to the new group controller 2. The elevator control unit 10 also sends to the group controller 2 data about the movement direction of the elevator car 6, and the group controller 2 uses the data about the floor position 5A, 5B, 5C of the elevator car 6 and about the movement direction in the allocation of elevator calls in the manner described above.

FIG. 2 presents the elevator installation of FIG. 1, in which the modernization has progressed such that the elevator 1C' is already modernized but other elevators 1A and 1B are still awaiting modernization. In elevator 1C' both the elevator mechanics and the electrification of the elevator have been modernized. In this connection, the elevator car 6', guide rails, elevator ropes and also the hoisting machine 14' of the elevator have been replaced. Also the frequency converter 11' supplying electric power to the hoisting machine as well as the call-giving devices 13' of the elevator car and the positioning apparatus of the elevator car in the hoistway has been replaced. The elevator control unit 10 already replaced earlier is, on the other hand, in its position and also remains permanently in use. The new electrification of the elevator can be connected directly to the elevator control unit 10, so that the interface unit 4 is removed as it is superfluous. In this embodiment of the invention the new group controller 2 is also further connected to the new elevator control unit 10 via the same serial interface bus 12 as before.

In the transition phase of the modernization according to FIG. 2, only some of the elevators have been modernized, so that the elevator installation is composed of both modernized 1C' and still unmodernized 1A, 1B elevators. In this case the new group controller 2 is configured to select, on the basis of both the floor positions 5A, 5B, 5C and of the movement directions of the elevator cars 6, 6' of both the unmodernized and the modernized elevators, either an unmodernized 1A, 1B or a modernized 1C' elevator to serve the elevator call. The new group controller 2 also sends an elevator call to the modernized 1C' or the unmodernized 1A, 1B elevator selected to serve it via the serial interface bus 12.

It is obvious to the person skilled in the art that the invention is not limited solely to the examples described above, but that it may be varied within the scope of the claims presented below.

The invention claimed is:

1. A method for modernizing an elevator installation comprising two or more elevators, said method comprising the steps of:

connecting a new group controller to the elevator installation, which group controller is operable to allocate an elevator call given with a call-giving device to be served by an elevator belonging to the elevator installation;

fitting a new measuring device to an unmodernized elevator, which measuring device is operable to measure an operating parameter of the unmodernized elevator;

connecting the measuring device to the new group controller for communicating the measured operating parameter to the new group controller;

selecting an unmodernized elevator on the basis of the operating parameter with the new group controller to serve the elevator call;

allocating the elevator call with the new group controller to the unmodernized elevator selected to serve the elevator call; and moving the unmodernized elevator selected to serve the elevator call with the new group controller.

2. The method according to claim 1, that further comprising the steps of:

modernizing at least one elevator;

selecting the modernized elevator on the basis of the operating parameter with the new group controller to serve the elevator call; and allocating the elevator call with the new group controller to the modernized elevator selected to serve the elevator call.

3. The method according to claim 1, further comprising the steps of:

modernizing at least one elevator; and connecting the new group controller to the modernized elevator for allocating an elevator call to be served by the modernized elevator.

4. The method according to claim 3, that further comprising the steps of:

on the basis of the operating parameter selecting a modernized elevator with the new group controller to serve an elevator call; and allocating the elevator call with the new group controller to the elevator selected to serve the elevator call.

5. The method according to claim 1, wherein the operating parameter is the floor position of an elevator car, said method comprising the step of:

configuring the measuring device to measure the floor position of an elevator car belonging to an unmodernized elevator.

6. The method according to claim 1, that further comprising the steps of:

providing the measuring device with a sensor detecting the door zone of an elevator; and fitting the sensor detecting the door zone of an elevator in connection with an elevator car belonging to an unmodernized elevator.

7. The method according to claim 1, that further comprising the step of:

connecting a new destination call device to the new group controller, with which destination call device an elevator call can be given, which comprises information about both the departure floor and about the destination floor of an elevator passenger.

8. A system for modernizing an elevator installation comprising two or more elevators, said system comprising:

an unmodernized elevator;

one or more call-giving devices;

a modernized elevator;

a new group controller, which is connected to the elevator installation for allocating an elevator call to be given with a call-giving device and to be served by an elevator belonging to the elevator installation; and a new measuring device, which is configured to measure an operating parameter of an unmodernized elevator, wherein the measuring device is connected to the new group controller for communicating the operating parameter to the new group controller, and the new group controller is configured to select on the basis of the operating parameter the unmodernized elevator to serve the elevator call, allocate the elevator call to the unmodernized elevator selected to serve the elevator call, and control to move the unmodernized elevator selected to serve the elevator call.

9. The system according to claim 8, wherein the new group controller is configured to select on the basis of the operating parameter the modernized elevator to serve the elevator call, and to allocate an elevator call to the modernized elevator selected to serve the elevator call.

10. The system according to claim 8, wherein the new group controller is configured to allocate an elevator call to be served by the modernized elevator.

11. The system according to claim 10, wherein the new group controller is configured to select on the basis of the operating parameter the modernized elevator to serve the elevator call, and to allocate an elevator call to the elevator selected to serve the elevator call.

12. The system according to claim 8, wherein the operating parameter is the floor position of the elevator car, and the measuring device is configured to measure the floor position of an elevator car belonging to an unmodernized elevator.

13. The system according to claim 8, wherein the measuring device is provided with a sensor detecting the door zone of an elevator, which sensor is fitted in connection with an elevator car belonging to an unmodernized elevator.

14. The system according to claim 8, wherein the system comprises a new destination call device, which is connected to the new group controller and is also configured to form an elevator call, which comprises information about both the departure floor and about the destination floor of a passenger.

15. The system according to claim 8, wherein the measuring device comprises a sensor, which is connected to an unmodernized elevator, and the measuring device is configured to process the measuring data received from the sensor and also to form the operating parameter on the basis of the processed measuring data.

16. The method according to claim 2, further comprising the steps of:

connecting the new group controller to the modernized elevator for allocating an elevator call to be served by the modernized elevator.

17. The method according to claim 2, wherein the operating parameter is the floor position of an elevator car, said method comprising the step of:

configuring the measuring device to measure the floor position of an elevator car belonging to an unmodernized elevator.

18. The method according to claim 3, wherein the operating parameter is the floor position of an elevator car, said method comprising the step of:

configuring the measuring device to measure the floor position of an elevator car belonging to an unmodernized elevator.

19. The method according to claim 4, wherein the operating parameter is the floor position of an elevator car, said method comprising the step of:

configuring the measuring device to measure the floor position of an elevator car belonging to an unmodernized elevator.

20. The method according to claim 2, further comprising the steps of:

providing the measuring device with a sensor detecting the door zone of an elevator; and fitting the sensor detecting the door zone of an elevator in connection with an elevator car belonging to an unmodernized elevator.

* * * * *